United States Patent [19]

Winter

[11] 4,266,311

[45] May 12, 1981

[54] MACHINE FOR REEVING AND/OR LASTING SHOES IN THE HEEL AND ANKLE PART

[75] Inventor: Gerhard Winter, Hauenstein, Fed. Rep. of Germany

[73] Assignee: Schon & Cie GmbH Maschinenfabrik, Pirmasens, Fed. Rep. of Germany

[21] Appl. No.: 49,188

[22] Filed: Jun. 15, 1979

[30] Foreign Application Priority Data

Jun. 19, 1978 [DE] Fed. Rep. of Germany ..... 2826740

[51] Int. Cl.[3] ..... A43D 21/00; A43D 23/00

[52] U.S. Cl. ..... 12/10.1; 12/14.5

[58] Field of Search ..... 12/10.1, 9, 9.1, 10, 12/10.5, 10.8, 12, 14.4, 14.5

[56] References Cited

U.S. PATENT DOCUMENTS

| | | | |
|---|---|---|---|
| 3,096,531 | 7/1963 | Rockwell | 12/14.5 |
| 3,273,183 | 9/1966 | Schindler | 12/14.5 |
| 3,506,992 | 4/1970 | Kamborian | 12/14.5 |
| 3,685,072 | 8/1972 | Schindler et al. | 12/12 |

*Primary Examiner*—Patrick D. Lawson

*Attorney, Agent, or Firm*—Friedman, Goodman & Teitelbaum

[57] ABSTRACT

A shoe lasting machine having a receiving device for a last, a heel band for holding a shoe upper on the last, a first wiper for shearing a heel portion of the shoe upper, a second wiper for wiping a side portion of the shoe upper, and a pincer disposed between the first and second wiper for gripping an edge portion of the upper, wherein the pincer moves over the last in a direction away from the last so that a pull directed away from the last is exerted on the edge portion to avoid forming a pocket in the upper. The pincer includes a pincer part articulated on a pincer base body for gripping the edge portion, wherein the pulling force for each individual pincher part and pincer base body is adjustable. The time point of the pincer opening is adjustable with respect to the movement of the wipers and the heel band. Preferably, the receiving device is arranged to receive the last in an upward-directed position, whereby the pincer is moved upwardly away from the last.

5 Claims, 5 Drawing Figures

MACHINE FOR REEVING AND/OR LASTING SHOES IN THE HEEL AND ANKLE PART

The invention relates to a device for reeving and/or lasting shoes in the heel and ankle part with a receiving device for the last and reeving devices for heel and ankle.

Known heel reeving or wiping devices consist of two shear plates. Reeving devices for the ankle have several reeving fingers arranged next to one another.

In the known arrangement the shear plate in the reeving or wiping operation makes an inward and simultaneously forward-directed movement. If in the same machine reeving fingers of the above-mentioned type are provided for the ankle, through this movement the upper edge is compressed between the end of the shear plate and the reeving fingers and forms in this place a pocket which even at the conclusion of the reeving operation is not entirely eliminated. Hitherto an endeavor has been made to obviate this defect by the means that shoe upper and shoe cap in this critical place (where the pocket is to be expected) are attached to the insole in a separate operation before the lasting. These two disadvantages (pocket and separate working operation, respectively) are to be eliminated by the present invention. For this it is proposed that in the space free in the rest position between the heel device and the ankle reeving device there be arranged a pincer in such a way that the pincer engages the upper edge and on approach of the shear or before this approach removes itself in a direction such that thereby a pull is exerted on the upper leather, and finally opens. The direction in which the pincer removes itself in or before the approach of the shear is directed generally upward if the machine is arranged in such a way that in the processing the last bottom faces upward. In a machine with a downward-directed last bottom the pincer are engaging the upper edge and on approach or before the approach of the shear would remove itself downward.

The present invention is explained in detail in the following with the aid of an example of execution with reference to the appended drawing.

Since heel lasting arrangement and side lasting arrangements have long belonged to the state of the art, the heel reeving or wiping device is not represented in detail. Reference is made rather to German patent application P 19 59 560.9 published in 1971, the priority of which was claimed in corresponding U.S. Pat. No. 3,685,072 granted in 1972, from the representation of which parts were taken over for the following example.

The machine to be described is, therefore, one in which its receiving device receives the last with upward-facing last bottom or insole and which, furthermore, contains reeving or wiping devices for heel and ankle as well as a heel band.

Figure 2:
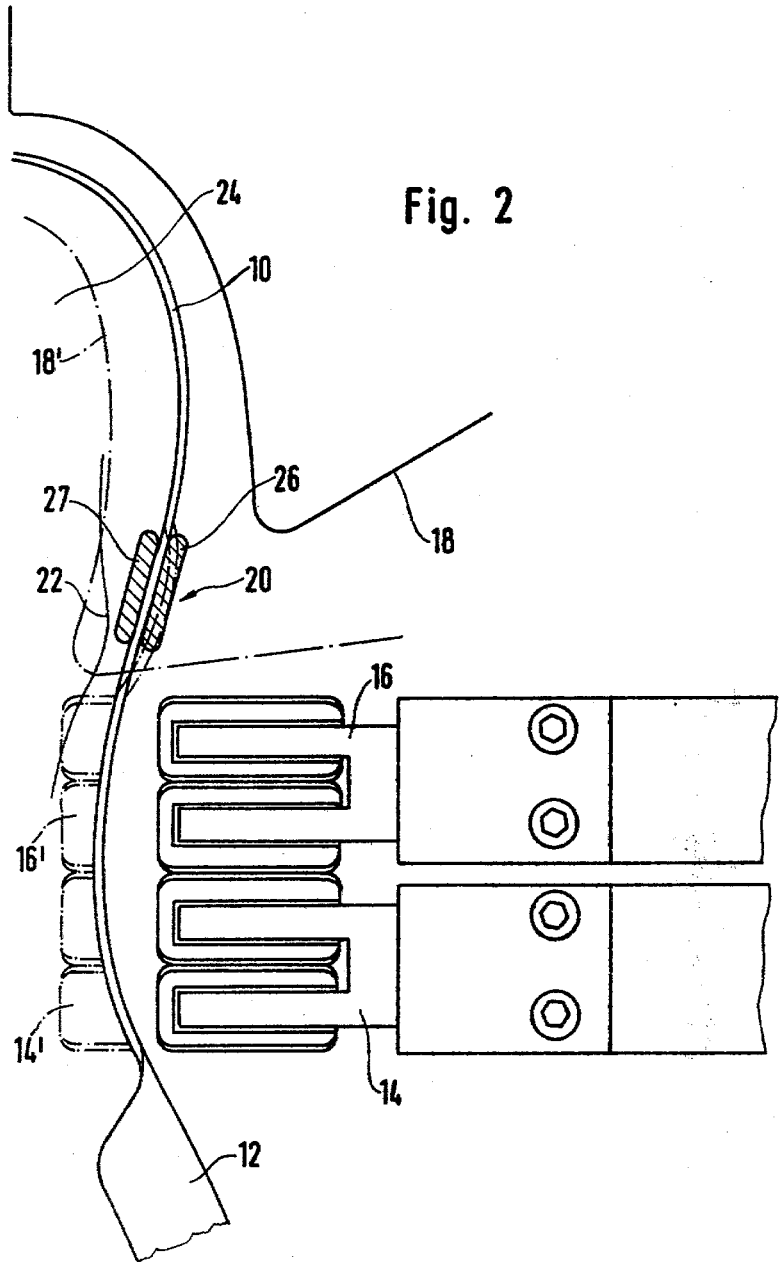
FIG. 2 shows a plan view of the heel and ankle reeving device in starting or rest state.
Figure 3:
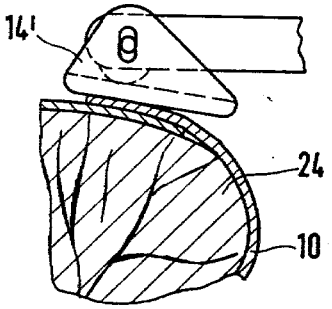
FIG. 3 shows a partial view of the last and of the side reeving device, partially sectioned in the section plane III—III of FIG. 4.
Figure 4:
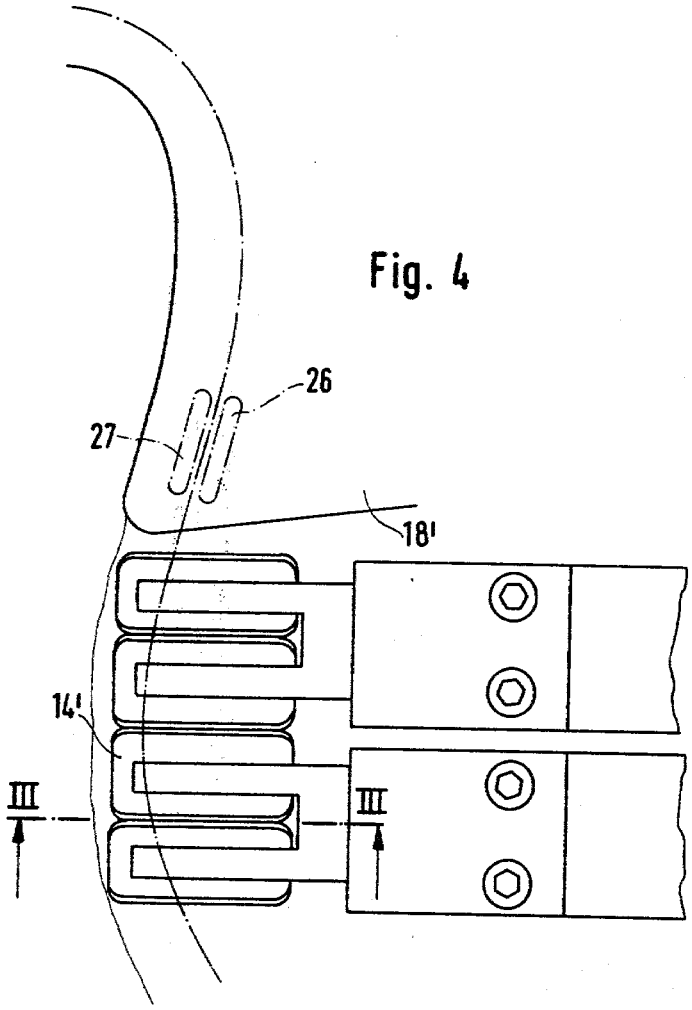
FIG. 4 shows a plan view corresponding to FIG. 2 of the heel and ankle sheering device in the reeved-in state.

In the representation according to FIG. 2 the upper 10 is reemed in the point zone by a point lasting machine, as the lasting turnover 12 in this zone shows. In FIG. 2 there are shown in solid lines the reeving or wiping fingers 14, 16 of the ankle or side wiper, and the edge of the shear 18 of the heel wiper intended for the reeving of the heel portion. These elements are represented, moreover, in dot-and-dashed lines in the position corresponding to the reeved-in state with 14', 16' and 18', as also shown in FIGS. 3 and 4. In broken line there is shown once at 20 the so-called pocket mentioned at the outset and at 22 the edge of the lasting turnover as it arises in the known system. As is to be from the drawing, the absence of a pull on the upper edge in the known process brings it about that the lasting turnover is very narrow. Finally, FIG. 2 shows, besides the last sole 24, the horizontal section through the pincer 26, 27 in the closed state, in engagement, therefore on the shaft 10.

Figure 1:
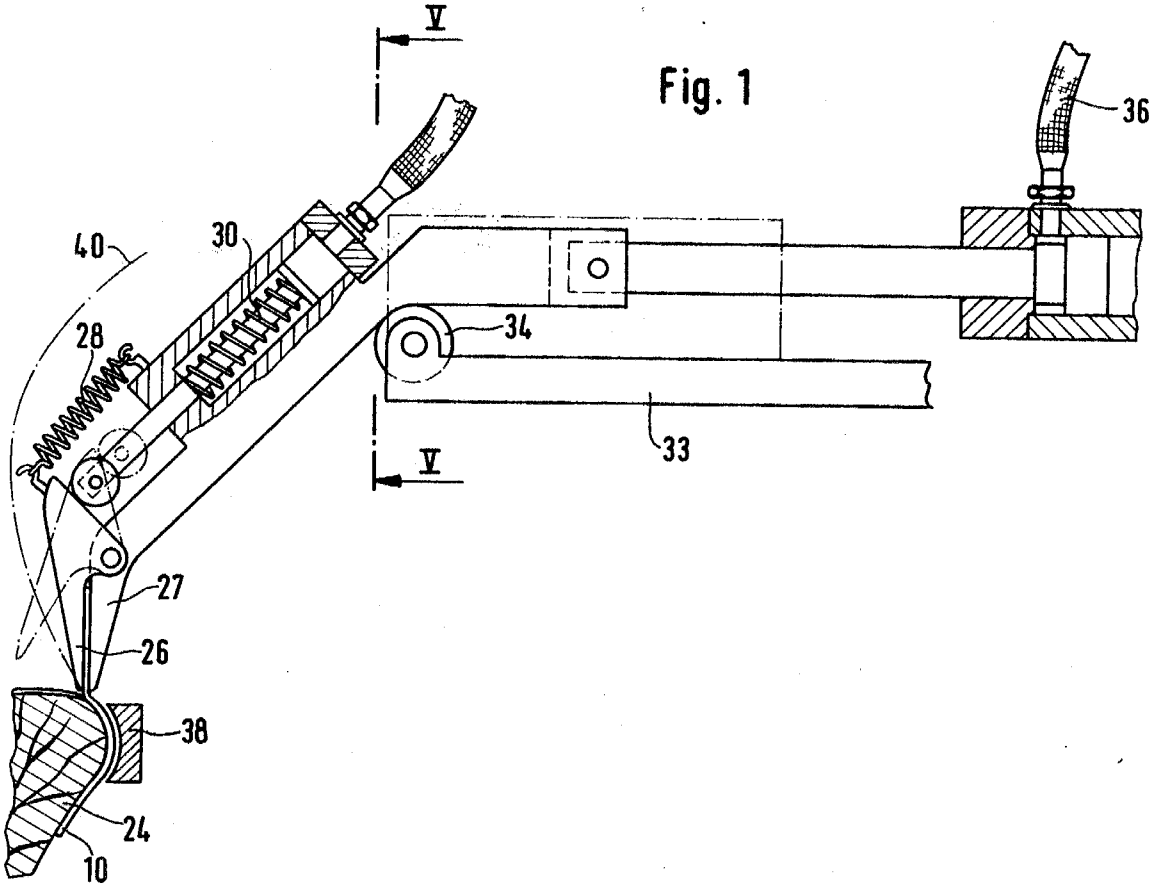
FIG. 1 shows a side view of the pincer mentioned with its drive device and the last.

The pincer arrangement, as shown in FIG. 1, is above the heel and ankle wiping devices. It can be adjusted in respect to the last 24 to a slight degree toward the middle of the last and in height. The pincer part 26 articulated on the pincer base body 27 is opened by the force of the springs 28 and 30 and closed by the device represented. The body 27 is borne on a roll 34 borne on the machine body 33. Through the form, bearing and operation depicted of the body 27, on introduction of pressure fluid into the line 36 it will not only shift to the right but will also move upward. In the rest position the pincer stands so that on starting or swinging-in of the last into its processing position the upper edge extends into the open pincer, as is shown in FIG. 1.

Figure 5:
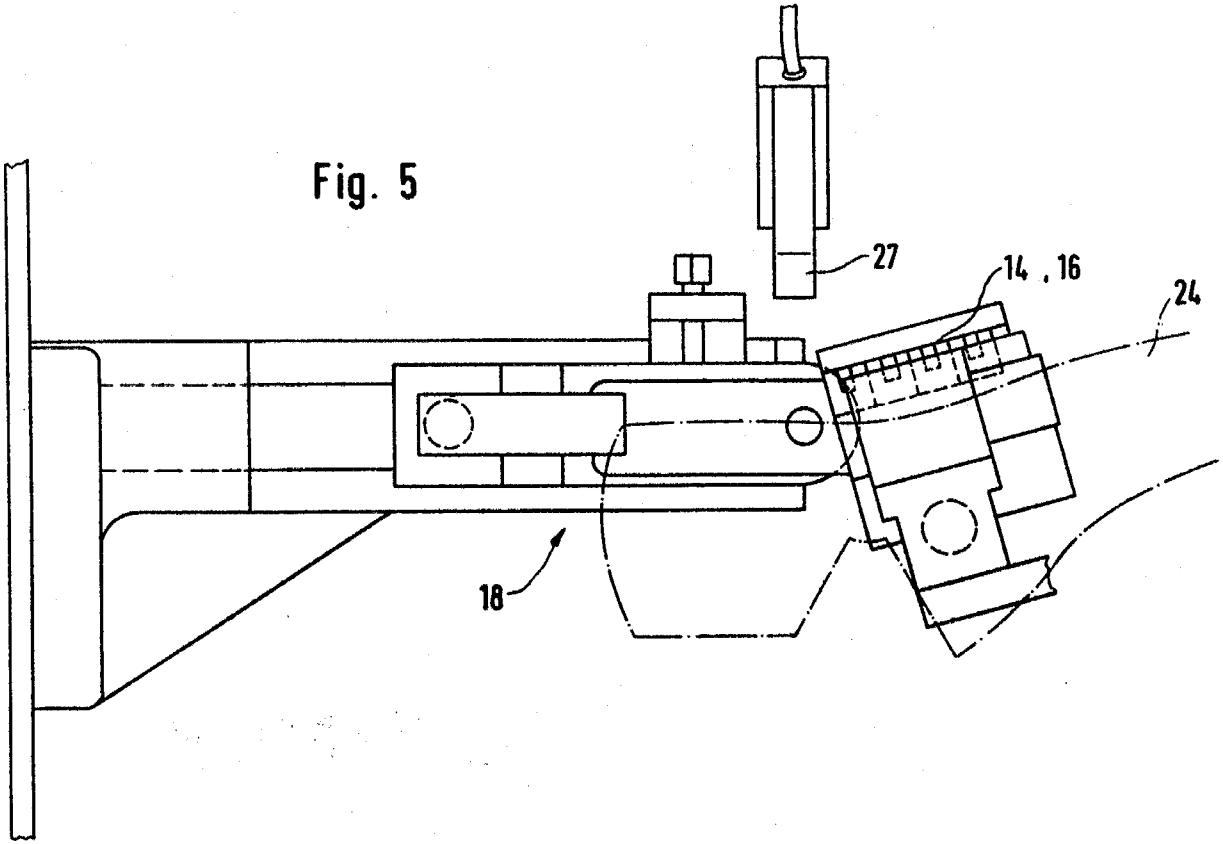
FIG. 5 shows the (simplified) side view of the reeving device with raised pincer and in viewing from the direction V—V of FIG. 1.

At the commencement of the lasting process the pincer 26, 27 closes and thereupon draws the upper edge 10 upward; the heel band 38, hitherto still open, surrounds the heel part of the last and thus holds the upper firmly on the last. When now the reeving movement begins, the pincers open and go up on the path 40 shown in dot-and-dashed lines in FIG. 1 to the raised position shown in FIG. 5. Thus, the pincers 26, 27 exert a pull on the upper edge which is directed outwardly away from the last bottom. Both the pulling force of the pincers and also their clamping force can be adjusted or regulated over regulating valves in the feed lines. The opening time point of the pincer is likewise settable or adjustable. Preferably the pulling force of each pincer is adjustable by itself (and individually). The time point of the pincer opening can be adjusted in respect to the movement of the reeving tools and of the heel band.

I claim:

1. A shoe lasting machine comprising a receiving device for a last, a heel band for holding a shoe upper on the last, a first wiper for shearing a heel portion of the shoe upper, a second wiper for wiping a side portion of the shoe upper, a pincer disposed between said first and second wiper for gripping an edge portion of the upper, and means for moving said pincer over the last in a direction outwardly away from the last so that a pull directed outwardly away from the last is exerted on the edge portion to avoid forming a pocket in the upper.

2. A machine according to claim 1 including means for adjusting the pulling force of said pincer.

3. A machine according to claim 1, wherein said pincer includes a pincer part articulated on a pincer base body for gripping the edge portion, and means for individually adjusting the pulling force of said pincer part and said pincer base body.

4. A machine according to claim 1 including means for adjusting the time point of the pincer opening with respect to the movement of said first and second wipers and said heel band.

5. A machine according to claim 1, wherein said receiving device is arranged to receive the last in an upward-directed position, whereby said pincer is moved upwardly away from the last.

* * * * *